US005791099A

United States Patent [19]

Duffy

[11] Patent Number: 5,791,099

[45] Date of Patent: Aug. 11, 1998

[54] MULTI-WALLED, SECTIONAL SWIMMING POOL FABRICATED OF PREFORMED PLASTIC OR RESIN

[75] Inventor: Keith J. Duffy, Amsterdam, N.Y.

[73] Assignee: Pacific Industries, Inc., Latham, N.Y.

[21] Appl. No.: 733,796

[22] Filed: Oct. 18, 1996

[51] Int. Cl.[6] ..... E04H 4/04

[52] U.S. Cl. ..... 52/169.7; 52/245; 52/249; 52/309.1; 52/582.1; 52/585.1

[58] Field of Search ..... 52/169.7, 245, 52/249, 585.1, 582.1, 309.1

[56] References Cited

U.S. PATENT DOCUMENTS

| | | | |
|---|---|---|---|
| 3,396,500 | 8/1968 | Lankheet . | |
| 3,562,822 | 2/1971 | Wall | 52/245 |
| 3,660,957 | 5/1972 | Schankler | 52/169.7 X |
| 3,801,993 | 4/1974 | Stalder | 52/169.7 |
| 3,938,199 | 2/1976 | Laven | 52/169.7 X |
| 3,955,220 | 5/1976 | Kessler . | |
| 4,109,324 | 8/1978 | Cornelius . | |
| 4,177,614 | 12/1979 | Arp . | |
| 4,364,211 | 12/1982 | Boyack . | |
| 4,407,102 | 10/1983 | Boyack . | |
| 4,548,005 | 10/1985 | Glonek et al. . | |
| 4,756,033 | 7/1988 | Schelfhorst . | |
| 4,860,914 | 8/1989 | Derni et al. | 52/169.7 X |
| 5,054,135 | 10/1991 | Dallaire et al. . | |
| 5,134,819 | 8/1992 | Boyack . | |
| 5,398,351 | 3/1995 | Watson . | |

FOREIGN PATENT DOCUMENTS

| | | |
|---|---|---|
| 1160790 | 8/1958 | France . |
| 1579005 | 8/1969 | France . |
| 2001 225 | 1/1970 | Germany . |
| 2145560 | 4/1973 | Germany . |

*Primary Examiner*—Christopher Kent
*Attorney, Agent, or Firm*—Heslin & Rothenberg, P.C.

[57] ABSTRACT

A swimming pool is formed of a plurality of multi-wall sections, each multi-wall section comprises a preformed plastic or resin and has an inner wall and an outer wall, with the inner wall and the outer separated to define an air space therebetween. The assembled pool walls are spaced a width w at a base of the swimming pool and taper to a width y at an intermediate height of the swimming pool between the base and a top of the swimming pool, wherein w>y. At the top of the swimming pool, the walls are separated a width x, wherein x>y. The swimming pool comprises an all plastic or resin construction, and may either be employed as an above-ground pool or an in-ground pool.

22 Claims, 11 Drawing Sheets

MULTI-WALLED, SECTIONAL SWIMMING POOL FABRICATED OF PREFORMED PLASTIC OR RESIN

TECHNICAL FIELD

The present invention relates in general to construction and assembly of swimming pools, and more particularly, to an all-plastic or resin, multi-walled sectional pool which is easy to assemble and durable.

BACKGROUND ART

A multitude of possibilities have been tried for swimming pool walls; and no solution is yet optimum, especially in northern regions where ice damage often occurs. A pool wall must be sturdy, watertight, durable, and easy to maintain; and yet price competition requires use of economically feasible materials. Also, pools are often installed by unskilled labor so that installation has to be relatively simple in order to produce reliable results with minimal skills.

The pool market today comprises pools made of various materials ranging from all metal to a combination of metal and plastic. The problem with metal, whether coated, dipped or laminated is that the metal will eventually rust from exposure to the elements. One recent development has been the molding of plastic uprights and top seats to inhibit rust, however, the main wall section has continued to be fabricated of metal. Further, a swimming pool is typically assembled using various size screws, washers and bolts that command a wide assortment of tools and a long, timely process to install. If disassembly of the pool is desired, the task can be time consuming and difficult due to corrosion of the metal connectors over time.

Pool panels prefabricated of plastic or resin material offer several advantages if they can meet the other desirable requirements. Such panels can be molded efficiently and be made light weight and economical to ship, and they resist deterioration for a potentially long life. However, they must achieve high strength without requiring too much material or molding expense. Ideally, a pool must also be designed to avoid complex assembly operations so that it can be put together easily and quickly by unskilled labor, preferably without requiring special tools. The joints must be adequately strong and the assembled wall must be strong enough to resist the expected forces from the pool water and any external force to hold its shape for many years. Failure to meet one or more of the above requirements has defeated most all previous suggestions.

DISCLOSURE OF INVENTION

The present invention has resulted from an analysis of the prior art problems of forming pool walls and proposes a way of configuring panels and assembling a pool wall to achieve both improved economic competitiveness and improved strength and reliability. The invention aims at overall economic competitiveness combined with sound and uniform construction of an all-plastic or resin pool. Further, the pool wall is made to accommodate movements from ice pressure so that the wall survives well in northern climates.

Briefly summarized, the invention comprises in one aspect a swimming pool fabricated of a plurality of multi-wall sections. Each multi-wall section is preformed from a substantially rigid plastic and has an inner wall and an outer wall. The outer wall is separated from the inner wall to define an air space therebetween. The swimming pool further comprises means for interconnecting the plurality of multi-wall sections to form the pool, wherein the pool has a substantially continuous inner pool wall and a substantially continuous outer pool wall. These walls are separated at a base of the pool a width w and the separation tapers to a width y at an intermediate height of the pool, between the base and a top of the pool, wherein w>y.

In another aspect, the invention again comprises a swimming pool having a plurality of multi-wall sections. Each multi-wall section is preformed of a substantially rigid plastic or resin, and has an inner wall and an outer wall. The outer wall is separated from the inner wall such that an air space exists therebetween. Each multi-wall section is free-standing during pool assembly. Means for interconnecting the plurality of multi-wall sections is provided to define the swimming pool. The multi-wall sections are designed such that during swimming pool assembly, the intermediate assemblies of the swimming pool are free-standing without the need for any in-ground support structure, which thereby facilitates construction of the pool.

In another aspect, a swimming pool is presented herein having an inner pool wall comprising a preformed substantially rigid plastic or resin and an outer pool wall also comprising a preformed substantially rigid plastic or resin. The inner pool wall and the outer pool wall are separated with an air space defined therebetween. The air space provides an envelope of air encircling the inner pool wall, and thereby any water in the swimming pool.

Various enhancements to the aspects of the present invention summarized above are also presented and claimed herein.

In all aspects, the present invention comprises an all-plastic or resin swimming pool construction. A sectional multi-wall design is employed to produce improved strength and reliability, as well as improving upon ease of assembly of the pool. This inventive system provides strong and secure joints between panels and allows simple and labor-saving joinery using plastic connectors. The all plastic or resin pool construction can employ wall sections of the same or different radii, so that a wide variety of pool shapes are possible.

The multi-wall sectional pool of this invention can be installed in significantly less time than an ordinary above-ground or in-ground swimming pool, and can be disassembled in practically the same amount of time as required to assemble. The multi-wall design of the upper and lower wall sections provides increased stability and strength and also provides an "envelope of air" around the inner swimming pool perimeter to help insulate the pool water from ambient temperature variations which could undesirably raise or lower water temperature. Preferably, the interior pool wall is tapered at a slight angle to deter damage caused by thawing ice. The pool wall is designed to accommodate movements of ice pressure so that the pool survives well in northern climates.

BRIEF DESCRIPTION OF DRAWINGS

The subject matter which is regarded as the present invention is particularly pointed out and distinctly claimed in the concluding portion of the specification. The invention, however, both as to organization and methods of practice, together with further objects and advantages thereof, may best be understood by reference to the following detailed description taken in conjunction with the accompanying drawings in which:

DETAILED DESCRIPTION OF THE INVENTION

Figure 1:
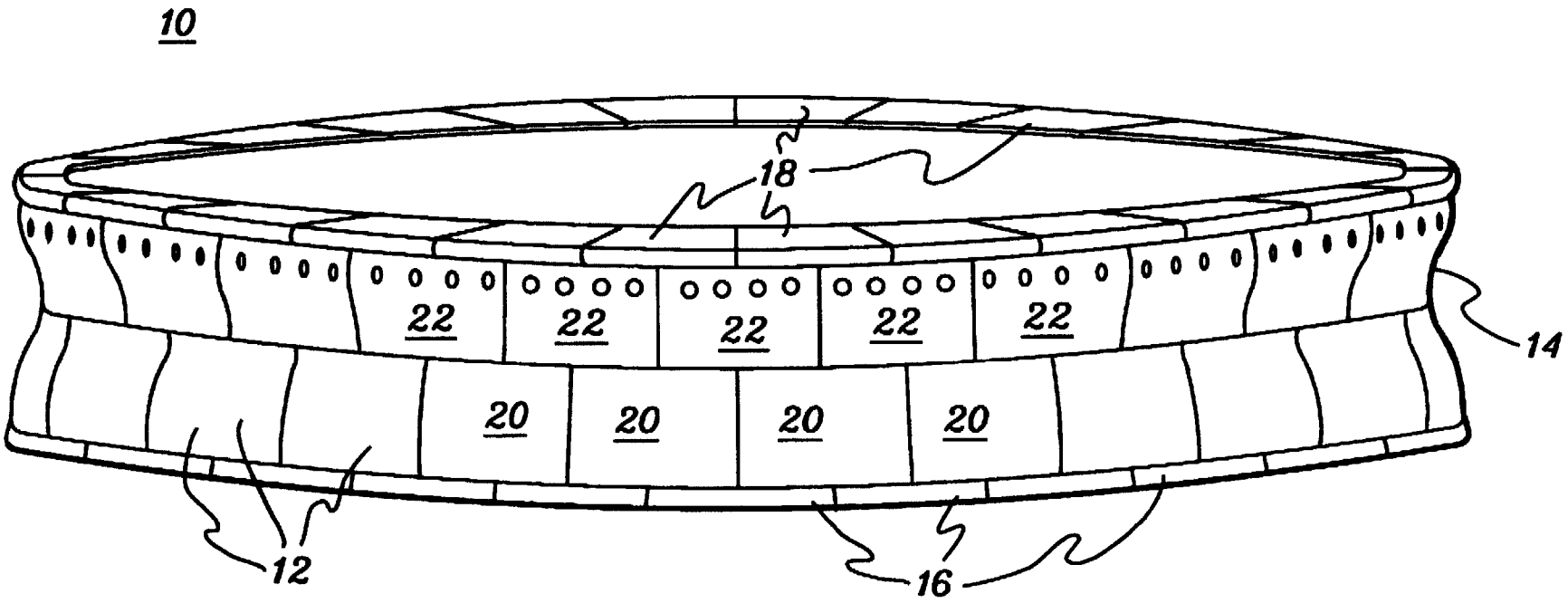
FIG. 1 is a perspective view of one embodiment of a swimming pool in accordance with the present invention.
Figure 9A:
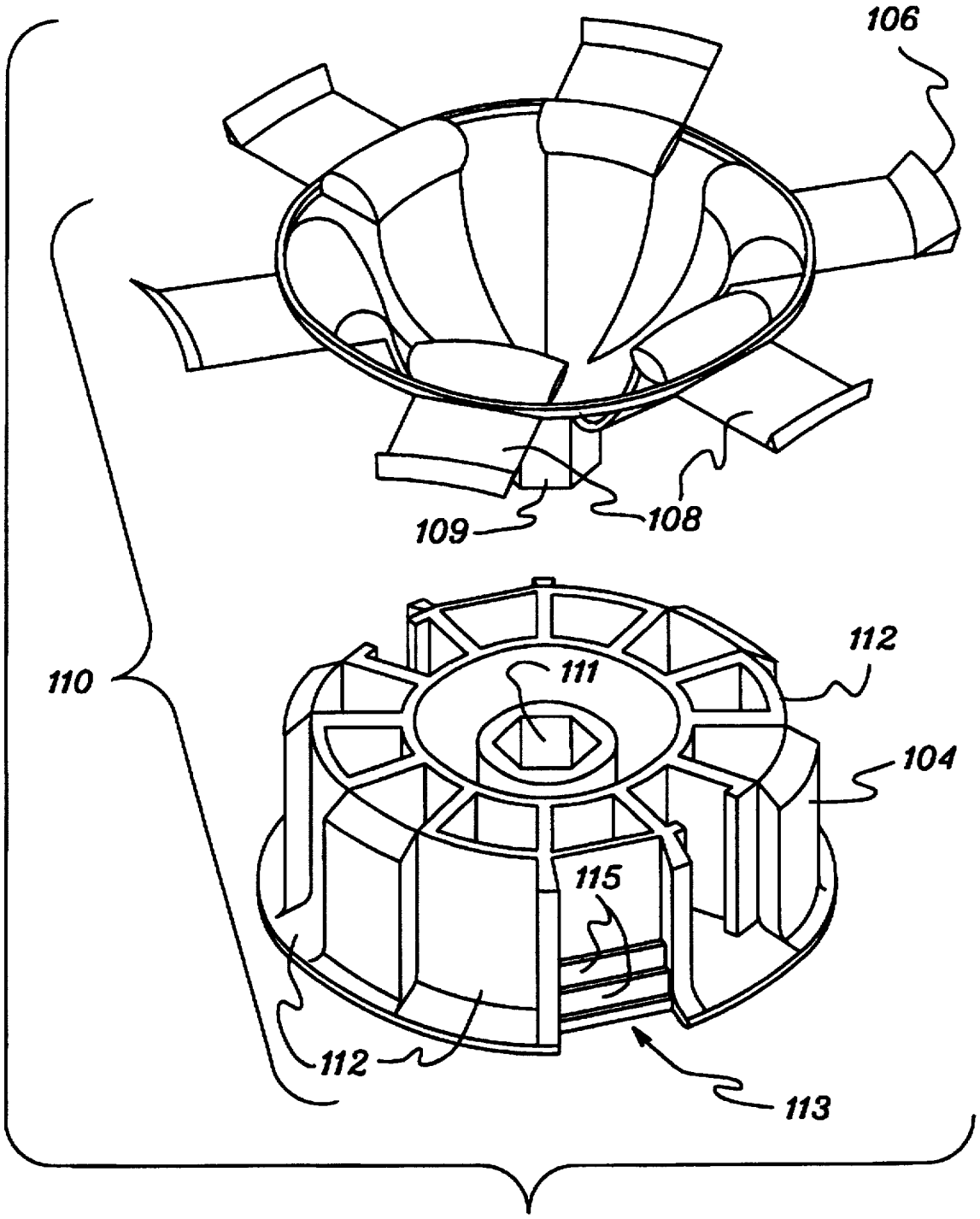
FIGS. 9*a* & 9*b* are perspective views of a connector cap and interlocking member of a two-piece plastic connector in accordance with the present invention.
Figure 9B:
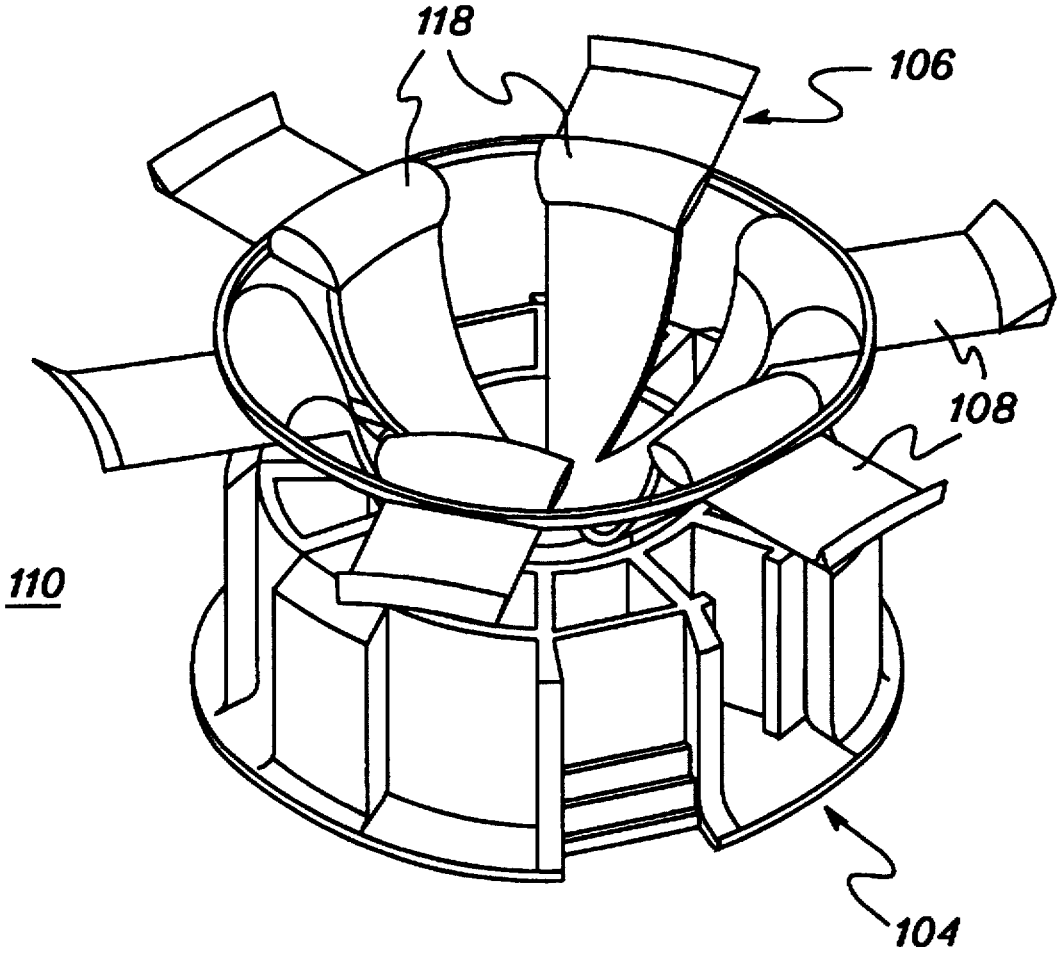
Figure 10:
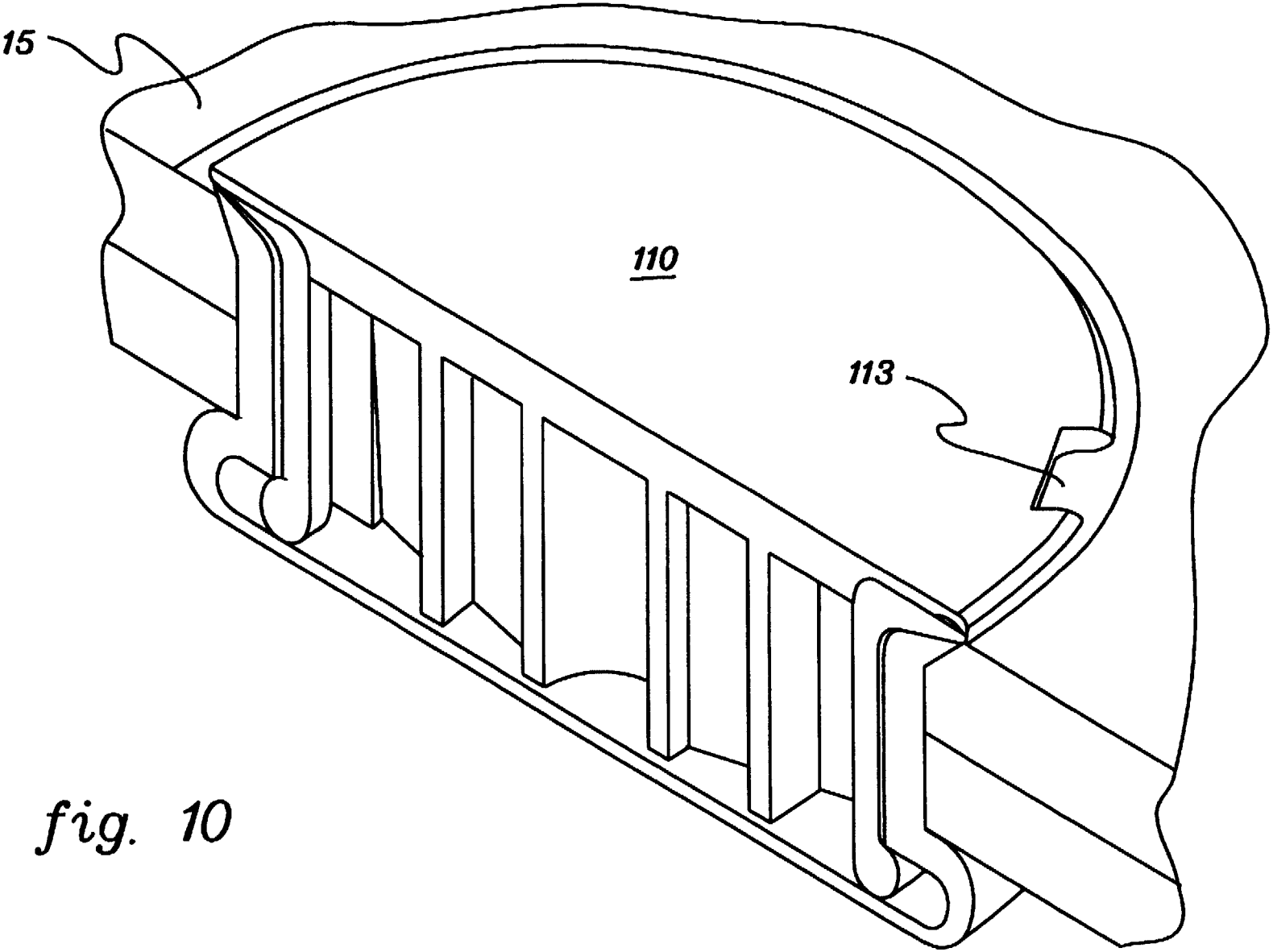
FIG. 10 depicts a partial perspective view of one embodiment of the two piece plastic connector of FIGS. 9*a*–9*b* shown in use.

Referring now to FIG. 1, one embodiment of a swimming pool 10 in accordance with the present invention is shown. Pool 10 comprises either an above-ground or in-ground circular-shaped pool fabricated of a plurality of multi-walled sections 12 which are staggered in assembly. An outer wall 14 of pool 10 has an "hour-glass" or concave shape as shown. Multi-walled sections 12 fit atop multiple base sections 16 and receive along an upper portion multiple rail sections 18. In accordance with this embodiment of the invention, multi-walled sections 12 comprise a first layer and a second layer of wall sections, i.e., a layer of lower wall sections 20 and a layer of upper wall sections 22. Base sections 16, lower wall sections 20, upper wall sections 22 and top rail sections 18 are respectively depicted in FIGS. 2–5 and described further below. The four basic sections of this design are locked together using a single type universal connector, which is depicted in FIGS. 9*a*, 9*b* & 10.

Figure 2:
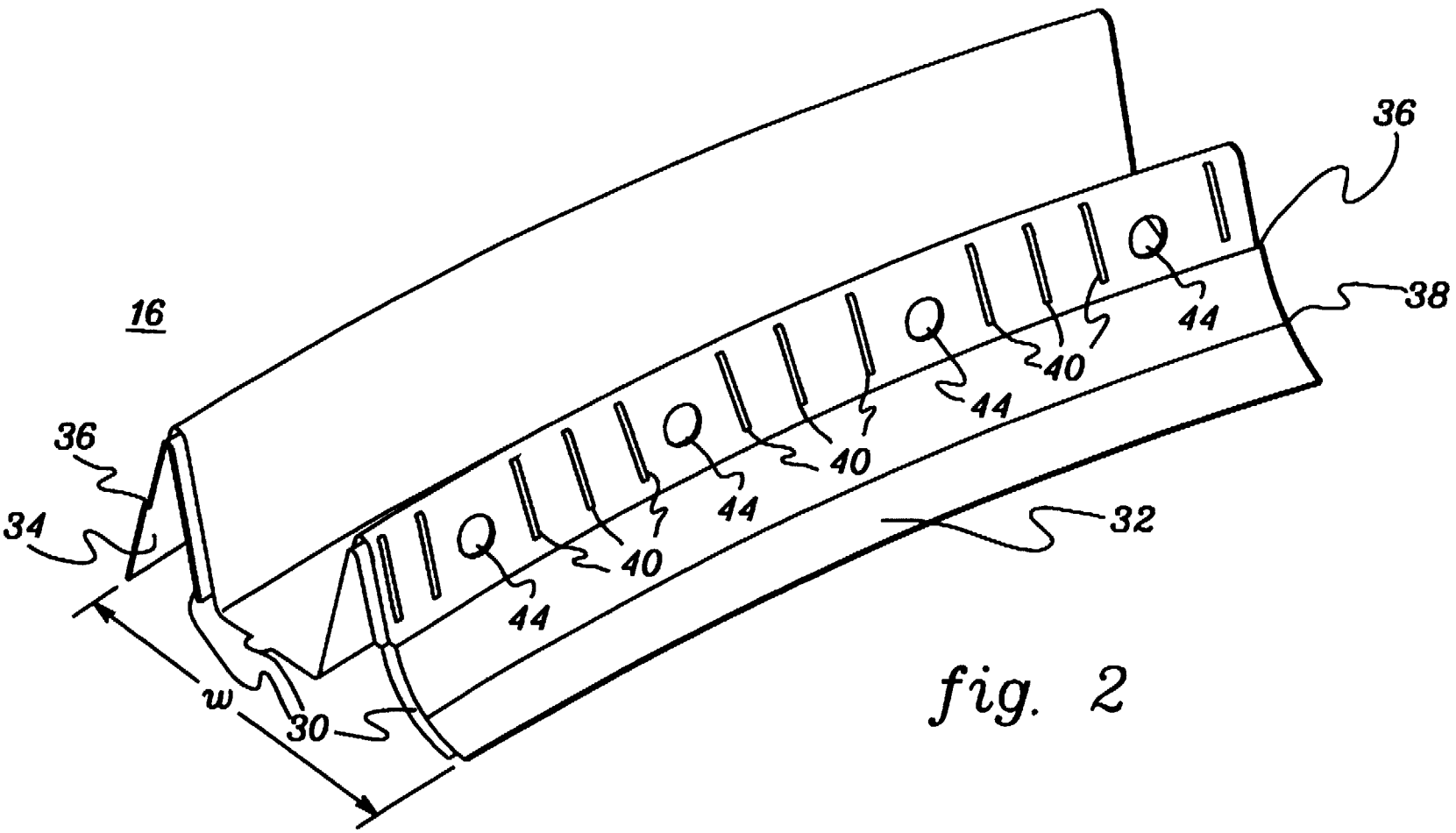
FIG. 2 depicts in perspective view one embodiment of a base section in accordance with the present invention.

The first basic section of this embodiment of the invention comprises base section 16 shown in detail in FIG. 2. During assembly, a plurality of identical, arcuate base sections 16 will be positioned on (or in) the ground, leveled and coupled together to define a circular base support for swimming pool 10. Other or additional base section 16 designs are possible depending upon the desired shape for swimming pool 10. For example, the pool could be oval shaped, kidney shaped, rectangular shaped, etc., in which case more than one preformed base section shape would be needed.

Base section 16 comprises a base plate which has tongues 30 at one end to interlock with grooves (not shown) at the other end of a next adjacent base section 16. Section 16 includes a curved inner support wall 32, which is designed as a molded cove to allow a pool liner (not shown) to rest cleanly on the bottom of the pool and protect the liner at the wall—bottom interface. Once the pool is assembled, support wall 32 forms a part of the inner pool wall, while an outer support wall 34 of base section 16 forms part of outer pool wall 14 (FIG. 1). Support walls 32 and 34 each contain a ledge 36, which is designed to receive the lower edge of a lower wall section 20 (FIG. 3) such that the inner and outer panels of the lower wall sections form a substantially continuous inner and outer surface with support walls 32 and 34 when the pool is assembled (see FIG. 6). A fill line 38 is also provided to guide an installer in placing sand, vermiculite or other material as base upon which the pool liner will rest.

Vertical grooves 40 exist on both support walls 32 and 34 of base section 16, and are sized and positioned to receive support ribs 42 (FIG. 3) which depend inward at the lower edge of the lower wall section 20 (FIG. 3) to reside upon two adjacent base sections. Preferably, a staggering of the base section joints and lower wall section joints occurs around the swimming pool for improved strength. Staggering is also preferred for the upper wall section joints relative to the lower wall section joints, as well as for the top rail section joints relative to the upper wall section joints.

Figure 3:
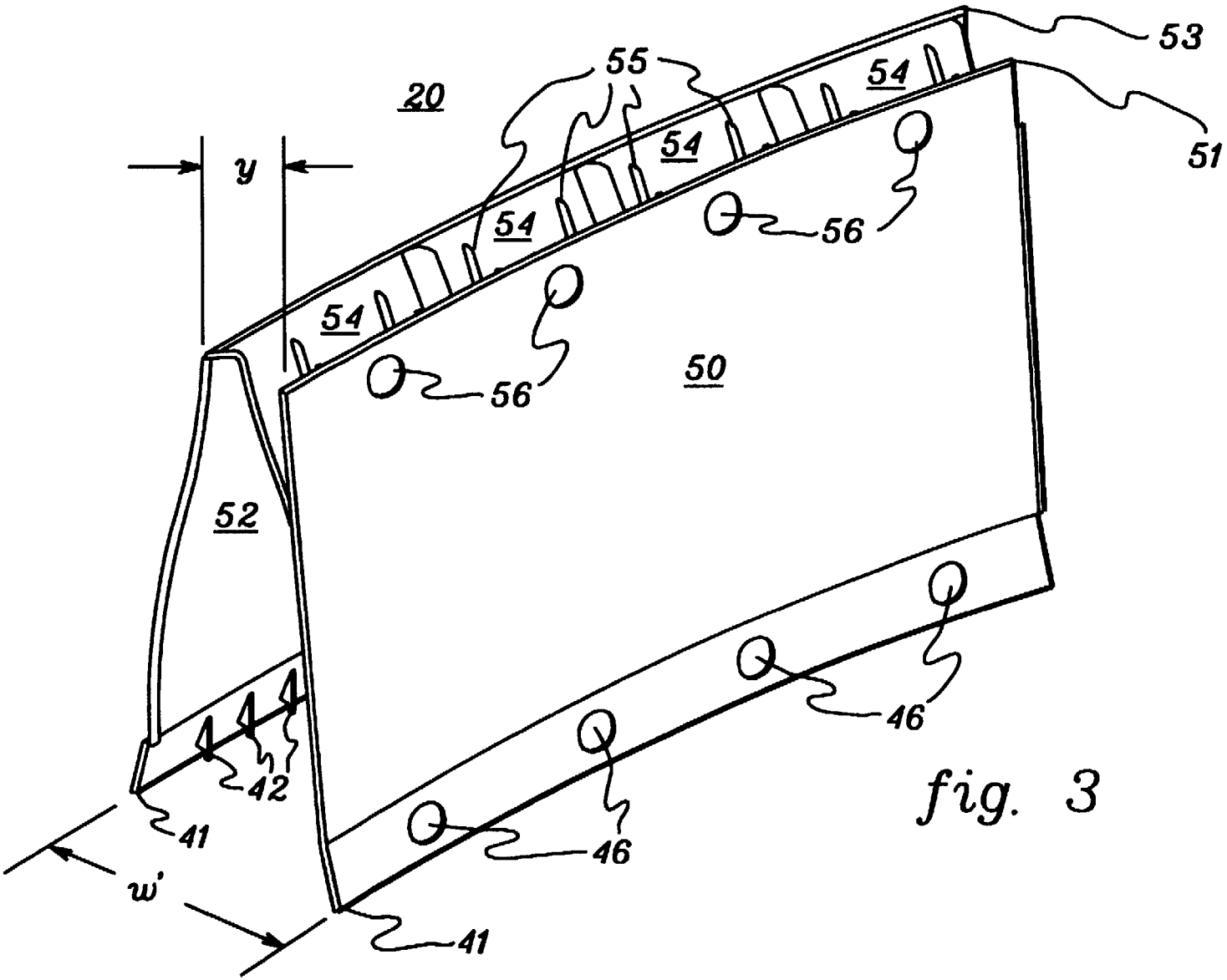
FIG. 3 depicts in perspective view one embodiment of a lower wall section in accordance with the present invention.

In the embodiment shown, support wall 32 includes four circular-shaped openings 44, which are positioned to align with corresponding openings 46 (FIG. 3) on the inner panels of two adjacent lower wall sections 20 (FIG. 3). Openings 44 & 46 are sized to receive the universal plastic connector discussed below in connection with FIGS. 9*a*, 9*b* & 10. In the base and lower wall section embodiments depicted in FIGS. 2 & 3, no connectors are used on the outer support wall of base section 16 and the outer panel of lower wall section 20. This is because gravity and the weight of the pool water are sufficient to maintain the ribs 42 of section 20 (FIG. 3) locked within the corresponding grooves 40 in outer support wall 36 of section 16 (FIG. 2).

As noted, FIG. 3 depicts one embodiment of a preformed, plastic or resin lower wall section 20 in accordance with the present invention. Section 20 includes an inner panel 50 and an outer panel 52 which are angled and shaped, respectively, to achieve the desired inner pool wall and outer pool wall configurations once assembled as described herein. Inner panel 50 has openings 46 along a lower edge thereof for interlocking the lower wall section across two adjacent base sections. Both inner panel 50 and outer panel 52 include support ribs 42 formed on inner surfaces thereof which are sized and disposed to engage grooves 40 in the two adjacent base sections when the sections are so assembled.

Upper edges 51 and 53 of inner and outer panels 50 & 52, respectively, are spaced a width y which is less than the width w of base section 16 (FIG. 2). Further, width y is less than the spacing w' between the lower edge 41 of inner panel 50 and the lower edge 41 of outer panel 52, so that preformed lower wall section 20 tapers from width w' to width y.

An advantage of the present invention is the provision of an "envelope of air" about the pool water once the swimming pool is constructed. This envelope of air is defined by spacing the inner and outer walls of each lower and upper multi-wall section. In essence, a continuous chamber is formed between the inner and outer walls of the assembled pool pursuant to the inner and outer panel spacings of the lower wall sections and the upper wall sections. In addition to the "envelope of air" this continuous chamber provides room for any plumbing desired in association with the pool. For example, a wall-mounted pool skimmer could be connected at an upper portion of the pool wall.

Figure 4:
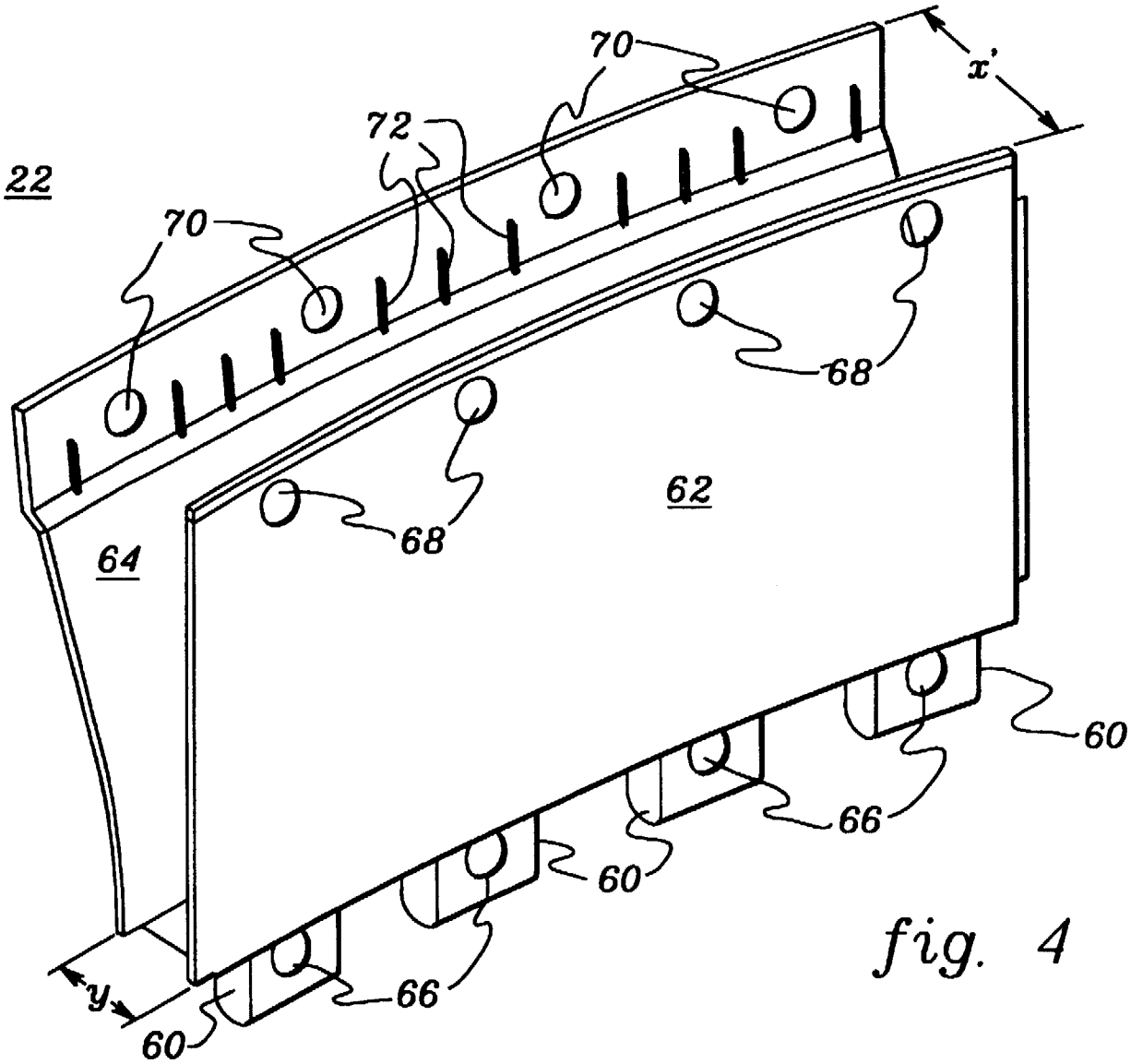
FIG. 4 depicts in perspective view one embodiment of an upper wall section in accordance with the present invention.

Section 20 includes tongue and grooves on opposite side edges to facilitate interlocking of adjacent lower wall sections during pool assembly. Preferably, after the base sections are leveled and physically coupled together, then the lower wall sections are assembled and interlocked thereto. The upper portion of section 20 includes multiple harnesses 54 connecting inner panel 50 and outer panel 52. Each harness section 54 is sized and shaped to receive a finger 60 (FIG. 4) projecting downward from a corresponding upper wall section 22 (FIG. 4). Further, each harness section 54 includes grooves 55 for interlocking with ribs (not shown) along the lower surfaces of fingers 60 to ensure proper positioning and interlocking of a corresponding upper wall section straddling two lower wall sections. Again, each upper wall section preferably straddles at least two adjacently coupled lower wall sections. Inner panel 50 includes openings 56 which align with corresponding openings 66 on fingers 60 of upper wall section 22 (FIG. 4). When aligned, openings 56 & 66 receive the same type universal connector as employed to connect the lower wall sections 20 to base sections 16. Again, one embodiment of such a connector is depicted in FIGS. 9*a*, 9*b* & 10.

Referring to FIG. 4, this embodiment of upper wall section 22 has an inner panel 62 and an outer panel 64 which are spaced apart width y at a lower portion thereof and expand to a width x' at an upper portion, wherein x'>y. As noted initially, when assembled the preformed lower wall section and preformed upper wall section together principally define the tapering of the inner pool wall and the concave shape of outer pool wall.

Upper wall section 22 also has tongue and grooves on opposite side edge surfaces to facilitate interlocking of adjacent sections 22 during pool wall assembly. The upper portion of upper wall section 22 contains openings 68 and 70 in inner panel 62 and outer panel 64, respectively, which are sized and positioned to align with openings in a top rail section 18 (FIG. 1) straddling at least two adjacent upper wall sections. Openings 68 and 70 are preferably sized the same as all other openings in the pool wall so that the single type universal connector can connect the upper wall sections and top rail sections. Ribs 72 are provided on the inner surface of outer panel 64 to ensure proper alignment and interlocking of a top rail section to the upper wall section. The top rail section has corresponding grooves in a downwardly depending member thereof.

Figure 5:
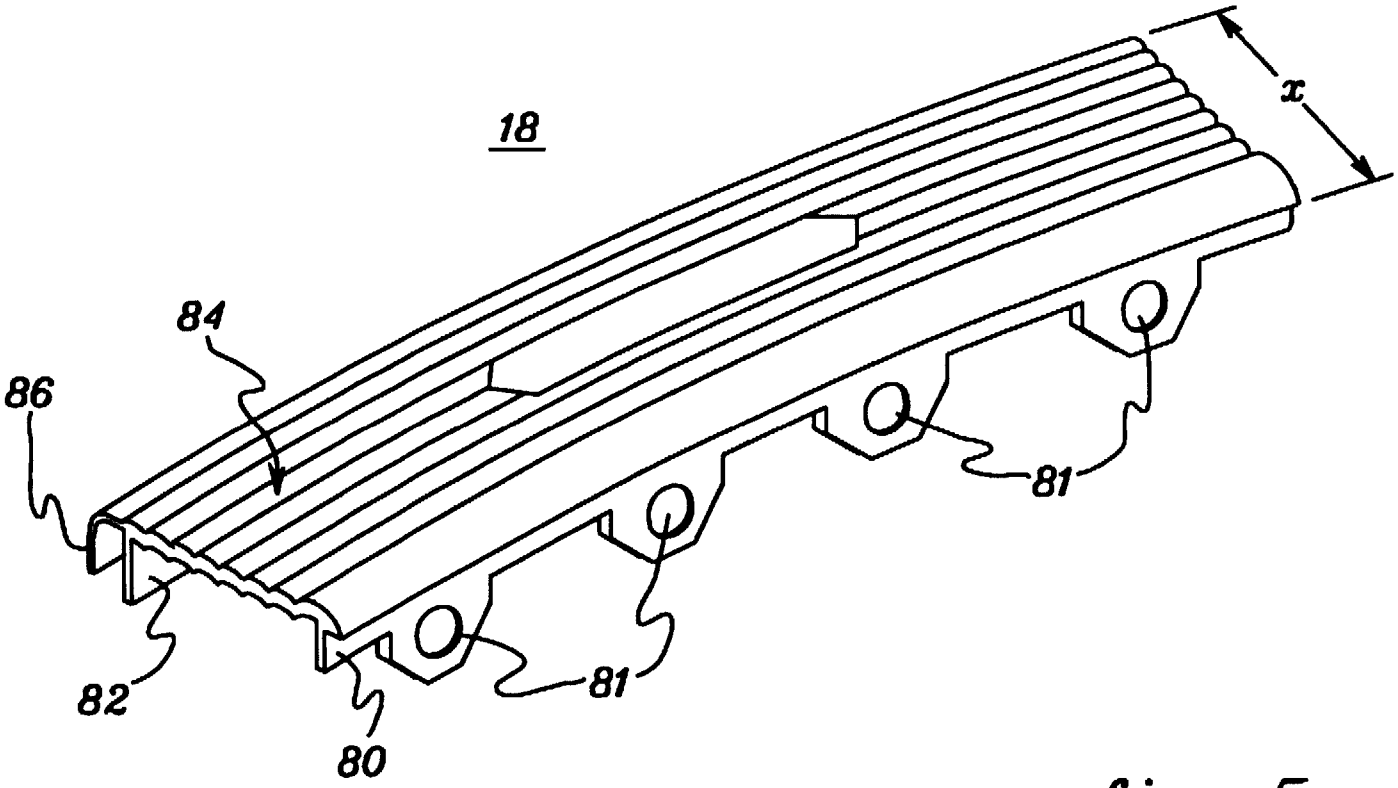
FIG. 5 depicts in perspective view one embodiment of a top rail section in accordance with the present invention.

One embodiment of top rail section 18 is depicted in FIG. 5. As noted, section 18 is sized to reside atop and straddle two adjacent upper wall sections 22 once the upper wall sections are interlocked above the lower wall sections. Top rail section 18 includes an inner downwardly depending member 80 and an outer downwardly depending member 82, each of which has openings 81 sized and positioned to align with openings 68 and 70 in the inner and outer panels of the upper wall sections, respectively. A top surface 84 of section 18 is sinusoidal shaped and textured for improved traction, for example, to facilitate sitting on the top rail. An outermost lip 86 depends downward from the top surface of top rail section 18, for example, to allow for the use of pool cover tie downs (not shown). The top rail section has an outer width x, wherein x>x'.

Figure 6:
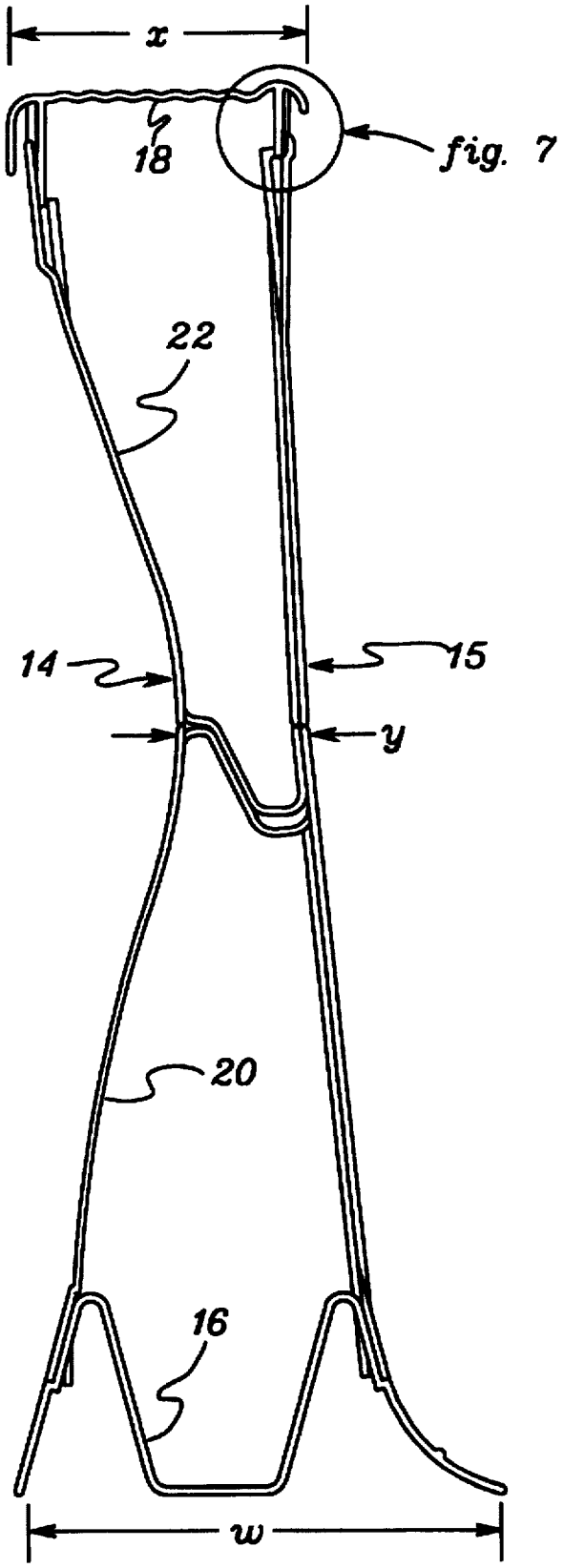
FIG. 6 is a cross-sectional view of an assembled pool wall showing a base section, lower wall section, upper wall section and top rail section of the embodiments depicted in FIGS. 2–5.

A cross-section assembly of the base section, lower wall section, upper wall section and top rail section of FIGS. 2–5 is depicted in FIG. 6. This pool wall comprises a double wall structure having the inner 15 and outer 14 pool wall configurations noted above. Dimensions can vary without departing from the present invention. As an example, however, width w of base section 16 might comprise 16.5 inches, width y at the upper/lower section connection (i.e., intermediate level of the swimming pool) might be 4–6 inches, while width x at the upper surface of top rail 18 could comprise 10.5 inches. Each of sections 16, 20, 22 & 18 is preferably fabricated of the same type resin or plastic, such as a polymer material which resists degradation. Another feature of the present invention is protection of the inner pool wall 15 from receiving direct sunlight by the presence of the outer pool wall 14. Thus, outer pool wall 14, in addition to providing structural support, also functions to extend the anticipated life of the all-plastic or resin pool. Further, the outer pool wall is necessary to define the above-described "envelope of air" surrounding the pool water. Those skilled in the art should also note that all or at least some of the multi-walled sections could comprise three or more walls. For example, a center wall could be employed between the inner wall and the outer wall for added strength if desired.

Figure 7:
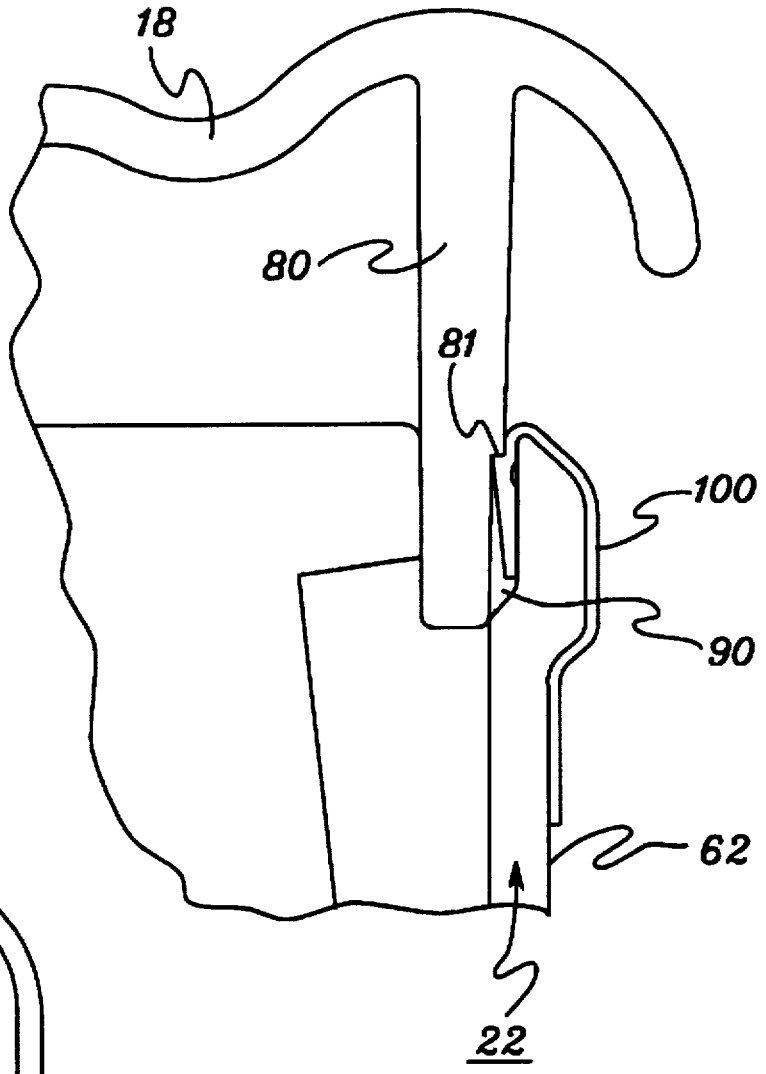
FIG. 7 depicts a partially enlarged view of FIG. 6 showing positioning of a beaded pool liner between the upper wall section and the top rail section.
Figure 7A:
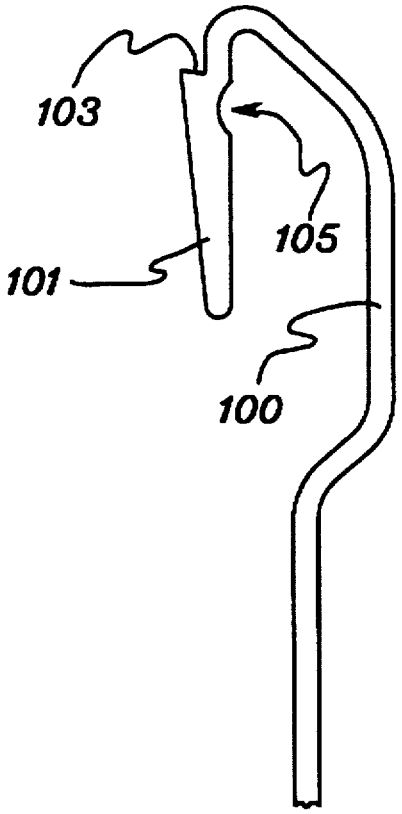
FIG. 7*a* depicts the beaded pool liner of FIG. 7.

In the enlarged cross-sectional view of FIG. 7, mating of the top rail section to the upper wall section at the inner pool wall is shown in greater detail. A groove 90 is defined at the upper edge of inner panel 62 of upper wall section 22. The inner downwardly depending leg 80 of top rail section 18 resides within this channel 90. The channel is sized, however, to allow for positioning of a beaded liner 100 in the space defined between top rail 18 and upper wall section 22. In this way, the pool liner can be held in place about the pool without the use of conventional liner clips. FIG. 7*a* comprises an enlarged depiction of beaded pool liner 100. Liner 100 includes having a wedge-shaped end 101 defining a step 103 in the liner. Step 103 interlocks with a ledge 81 (FIG. 7) formed in leg 80 of top rail section 18. A concave area 105 in wedge-shaped end 101 of pool liner 100 facilitates removal of the pool liner via compression of the wedge-shaped end without requiring removal of the top rail sections.

Figure 8:
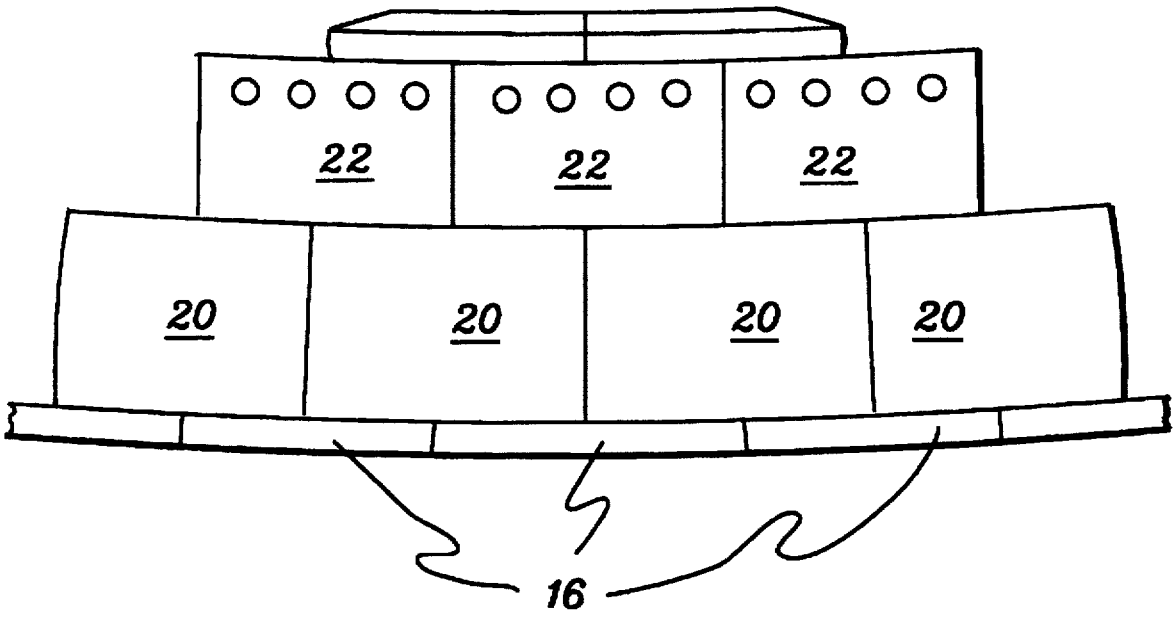
FIG. 8 is a perspective view of one possible intermediate assembly of a swimming pool in accordance with the present invention.

FIG. 8 depicts a possible intermediate assembly of the swimming pool of the present invention showing that the partially assembled pool is free-standing with no in-ground support structure needed. More particularly, during pool assembly the center of gravity of each intermediate assembly will always remain over the base sections such that the pool wall is always stable. This feature greatly facilitates assembly of the swimming pool.

FIGS. 9*a*, 9*b* & 10 depict one embodiment of a universal, two piece plastic or resin connector 110 useful in connecting the swimming pool sections of the present invention. Connector 110 comprises a connector cap 104 and an interlocking member 106 which are shown in FIG. 9*a* to be two separate structures. However, those skilled in the art will understand that the connector presented herein could also be molded as a single structure with the interlocking member integrated with the connector cap. Interlocking member 106 has legs 108 shaped and sized to reside within channels 112 formed in an outer circumference of connector cap 104. A hexagonal-shaped peg 109 allows interlocking member 106 to mate with connector cap 104 through engagement with a hexagonal-shaped opening 111 in the center of cap 104. Through peg 109 and opening 111, the legs 108 of the interlocking member 106 are aligned to channels 112 in the outer circumference of the connector cap. At least one notch 113 is provided in the outer circumference of connector cap 104 to facilitate removal of the connector from the swimming pool and thereby disassembly of the swimming pool. Steps 115 are formed adjacent to notch 113 to allow an individual to pry the connector from a locking position within the pool.

In use, connector 110 is push snapped into aligned openings of two sections of the swimming pool. This pushing operation occurs from one side of a swimming pool panel and does not require access to the center of the various swimming pool sections. The connector can either be manually pushed into aligned openings or a mallet could be employed to facilitate insertion of the connector into the openings. The universal connector 110 is depicted in locking position in FIG. 10. A bead 118 in each leg 108 of interlocking member 106 engages the remote surface of the aligned sections to lock the connector in place and thus the sections together. Preferably, the inner wall 15 or outer wall of the pool is beveled around the connector openings of the aligned sections so that the planar top surface of each connector cap is substantially co-planar with the surface of the inner wall or outer wall, respectively.

Those skilled in the art will note from the above discussion that presented herein is an all-plastic or resin swimming pool construction. A sectional multiple wall design is employed to produce improved strength and reliability, as well as improving upon ease of assembly of the pool. The individual sections of the pool are stackable and light weight for ease of handling. The system presented herein provides strong and secure joints between panels and allows simple and labor-saving joinery using a unique plastic connector. The swimming pool construction can employ wall sections of the same or different radii, depending upon the pool design desired. A wide variety of pool shapes are possible.

The all plastic or all resin swimming pool of this invention can be installed in less time than ordinary pools, and can be disassembled in practically the same amount of time as required to assemble. The multiple wall design of the upper and lower wall sections provides increased stability and strength and also provides an "envelope of air" around the entire inner pool perimeter to help insulate the pool water from variations in ambient temperatures which could undesirably raise or lower the pool water temperature. Preferably, the interior pool wall is tapered at a slight angle to deter damage caused by ice, e.g. when thawing. The pool wall is designed to accommodate movements of ice pressure so that the pool survives well in northern climates.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

What is claimed is:

1. A swimming pool comprising:

a plurality of multi-wall sections, each multi-wall section comprising a preformed plastic or resin, and having an inner wall, and an outer wall, said outer wall being spaced from said inner wall such that an air chamber is defined therebetween; and means for interconnecting the plurality of multi-wall sections to form the swimming pool, said swimming pool having a substantially continuous inner pool wall and a substantially continuous outer pool wall, said substantially continuous inner pool wall and said substantially continuous outer pool wall being separated at a base of the swimming pool a width w and tapering to a width y at an intermediate height of the swimming pool between the base and an upper portion of the swimming pool, wherein w>y.

2. The swimming pool of claim 1, wherein the plurality of multi-wall sections are freestanding when partially assembled and wherein said swimming pool comprises either an above-ground or an in-ground swimming pool.

3. The swimming pool of claim 1, wherein the substantially continuous inner pool wall and the substantially continuous outer pool wall are separated at the upper portion of the swimming pool, above the intermediate height, a width x, wherein x>y.

4. The swimming pool of claim 3, wherein the plurality of multi-wall sections comprises a first plurality of wall sections and a second plurality of wall sections, said first plurality of wall sections comprising a plurality of lower wall sections and said second plurality of wall sections comprising a plurality of upper wall sections, said plurality of lower wall sections and said plurality of upper wall sections being configured to interlock, with said plurality of upper wall sections residing above said plurality of lower wall sections, said plurality of upper wall sections matably engaging at a lower edge thereof said plurality of lower wall sections, said lower edge having said width y, and said plurality of upper wall sections having an upper edge with said width x.

5. The swimming pool of claim 4, further comprising a top rail formed of a plurality of interconnecting top rail sections, said top rail being disposed over said upper edge of said plurality of upper wall sections, and wherein said means for interconnecting includes means for connecting said plurality of top rail sections to said plurality of upper wall sections.

6. The swimming pool of claim 5, further comprising a plurality of base sections, said plurality of base sections being interconnected to form said base of the swimming pool, each base section having a curved inner support wall and a curved outer support wall, and wherein said means for interconnecting includes means for interconnecting said plurality of base sections and said plurality of lower wall sections.

7. The swimming pool of claim 6, wherein each section of said plurality of lower wall sections, said plurality of upper wall sections, said plurality of top rail sections, and said plurality of base sections comprises an arcuate-shaped section.

8. The swimming pool of claim 1, wherein said substantially continuous inner pool wall tapers downwardly inward towards a center of said swimming pool, and wherein said substantially continuous outer pool wall is concave shaped.

9. The swimming pool of claim 1, wherein said plurality of multi-wall sections nest together when disassembled to facilitate shipping thereof.

10. The swimming pool of claim 1, wherein said preformed plastic or resin of said plurality of multi-wall sections comprises one of a structural foam material and an injection molded material.

11. The swimming pool of claim 1, wherein said means for interconnecting comprises plastic or resin connectors and each connector comprises a connector cap and an interlocking member, each connector cap having a planar top surface which is co-planar with either said substantially continuous inner pool wall or said substantially continuous outer pool wall when in use to interconnect said plurality of multi-wall sections.

12. The swimming pool of claim 11, wherein at least some adjacent multi-wall sections of said plurality of multi-wall sections interconnected by the means for interconnecting include aligned openings, each of said aligned openings being sized to receive one connector, and wherein the interlocking member of each connector push snaps into a corresponding aligned opening for interconnecting corresponding multi-wall sections.

13. The swimming pool of claim 1, wherein said plurality of multi-wall sections includes a plurality of upper wall sections, and wherein said swimming pool further comprises a plurality of top rail sections, said plurality of top rail sections matably engaging and interlocking with said plurality of upper wall sections, with a channel being formed thereby between said substantially continuous inner pool wall and a depending member of said plurality of top rail sections, said channel being sized to receive and hold an edge of a pool liner therebetween.

14. A swimming pool comprising:

a plurality of multi-wall sections, each multi-wall section comprising a preformed resin or plastic having an inner wall and an outer wall, said outer wall being spaced from said inner wall such that an air space exists therebetween, each multi-wall section of said plurality of multi-wall sections being freestanding during pool assembly; and means for interconnecting the plurality of multi-wall sections to define the swimming pool, wherein during assembly, each intermediate assembly of the swimming pool is free-standing without any in-ground support structure.

15. The swimming pool of claim 14, wherein the swimming pool has an inner pool wall and an outer pool wall, the inner pool wall and the outer pool wall being separated at a base of the swimming pool a width w and tapering to a width y at an intermediate height of the swimming pool between the base and an upper portion of the swimming pool, wherein w>y, and wherein the inner pool wall and the outer pool wall are separated at the upper portion of the swimming pool above the intermediate height of the swimming pool a width x, wherein x>y.

16. The swimming pool of claim 14, wherein the swimming pool further comprises an inner pool wall and an outer pool wall, said inner pool wall sloping inwardly downward from an upper portion of the swimming pool, and said outer pool wall being concave shaped.

17. The swimming pool of claim 16, wherein said inwardly downward sloping of the inner pool wall is defined by three inner pool wall areas, a first area comprising an upper area is perpendicular to ground, a second area comprising an intermediate area has an approximately three degree inward slope from the first area, and a third area comprising a lower area has an approximately six degree inward slope from the first area.

18. A swimming pool comprising:

an inner pool wall comprising a preformed substantially rigid resin or plastic, and an outer pool wall comprising a preformed substantially rigid resin or plastic, said inner pool wall and said outer pool wall having an air space therebetween and being separated at a base of the swimming pool a width w and tapering to a width y at an intermediate height of the swimming pool between the base and an upper portion of the swimming pool, wherein w>y; and wherein said air space comprises an envelope of air encircling the inner pool wall, and thereby any water in the swimming pool.

19. The swimming pool of claim 18, wherein said inner pool wall slopes downwardly inward towards a center of the swimming pool.

20. The swimming pool of claim 19, wherein said inner pool wall and said outer pool wall are separated at the upper portion of the swimming pool above the intermediate height of the swimming pool a width x, wherein x>y.

21. The swimming pool of claim 20, wherein width w>width x.

22. The swimming pool of claim 21, wherein said outer pool wall is concave shaped.

* * * * *